US005667005A

United States Patent [19]

Kakutani et al.

[11] Patent Number: 5,667,005

[45] Date of Patent: Sep. 16, 1997

[54] HEAT EXCHANGING UNIT AND HEAT EXCHANGING APPARATUS

[75] Inventors: Yuzuru Kakutani; Hitoshi Konishi, both of Yokohama; Kazuhiko Asada, Takasago; Shinichiro Kashihara, Kobe, all of Japan

[73] Assignees: JGC Corporation, Tokyo; Kobe Steel, Ltd., Hyogo, both of Japan

[21] Appl. No.: 415,519

[22] Filed: Apr. 3, 1995

[30] Foreign Application Priority Data

Apr. 4, 1994 [JP] Japan ..... 6-087198

[51] Int. Cl.[6] ..... F25B 39/02

[52] U.S. Cl. ..... 165/114; 165/143; 165/DIG. 183; 165/111

[58] Field of Search ..... 165/111, 114, 165/143, 144; 62/40, 120

[56] References Cited

U.S. PATENT DOCUMENTS

| | | | |
|---|---|---|---|
| 2,084,743 | 6/1937 | Rathbun | 165/114 |
| 2,960,837 | 11/1960 | Swenson et al. | 62/24 |
| 3,596,473 | 8/1971 | Streich | 62/28 |
| 3,884,045 | 5/1975 | Stark et al. | 62/9 |
| 4,195,979 | 4/1980 | Martin | 62/26 |
| 4,814,044 | 3/1989 | Hitt | 196/98 |

*Primary Examiner*—Allen J. Flanigan
*Attorney, Agent, or Firm*—Cushman Darby & Cushman IP Group of Pillsbury Madison & Sutro LLP

[57] ABSTRACT

A heat exchanging unit is provided that includes a closed vessel separated into first and second compartments by a vertical partition plate thereby leaving a passage above the vertical partition plate. The first compartment has a cooling medium inlet pipe connected thereto, and a through pipe, through which a fluid to be cooled is passed. The through pipe is arranged to pass through the first compartment and includes a heat exchange member placed at a location lower than the top of the vertical partition plate. The second compartment is provided with a demister, and a cooling medium gas outlet pipe connected to the demister. A cooling medium liquid outlet pipe is connected to the second compartment. The heat exchanging unit is preferably used as part of a combined heat exchanging apparatus formed by combining the heat exchanging unit with a mist processing unit, or as part of a multistage heat exchanging apparatus formed by integrating two or more of the heat exchanging units.

18 Claims, 2 Drawing Sheets

HEAT EXCHANGING UNIT AND HEAT EXCHANGING APPARATUS

BACKGROUND OF THE INVENTION

1. Field of the Invention:

The present invention relates to a heat exchanging unit, especially to a kettle-type heat exchanging unit used for precooling in natural gas liquefaction, purification in ethylene production, LPG (Liquefied Petroleum Gas) recovery from natural gas, etc., which uses the latent heat of evaporation of a cooling medium. The present invention further relates to a heat exchanging unit in which it is possible to reduce the size of the suction drum disposed upstream of a compressor used for separating mist from a gasified cooling medium generated from using of the latent heat of evaporation of the cooling medium.

2. Description of the Related Art:

For natural gas liquefaction, ethylene purification, LPG recovery, etc. by low temperature processing, a kettle-type heat exchanger is used. The conventional kettle-type heat exchanger includes a closed vessel having a cooling medium liquid retaining zone, a cooling medium gas holding zone located thereabove, and a through pipe through which fluid to be cooled is passed through the cooling medium liquid retaining zone of the closed vessel.

When the cooling medium liquid is charged in the closed vessel through an expansion valve, it expands under reduced pressure to gasify partly and its liquid temperature is lowered to a boiling point temperature corresponding to the pressure inside the closed vessel.

The resulting low temperature cooling medium liquid in the cooling medium liquid retaining zone cools the fluid to be cooled flowing through the through pipe, and gasifies partly. The resultant gas moves to the cooling medium gas holding zone.

A number of these kettle-type heat exchangers are so connected in a multistage system so as to progressively decrease the pressure and the boiling point of the cooling medium, thereby gradually lowering the temperature of the fluid to be cooled.

The cooling medium gas retained in the cooling medium gas holding zone includes a mist formed during boiling of the cooling medium liquid. This cooling medium gas is generated from contact of the cooling medium liquid with the heat exchanger, and is thereafter it is compressed, liquefied and recycled for use as a cooling medium liquid. The cooling medium mist included with the cooling medium gas discharged from the heat exchanger must be separated prior to the compression of the cooling medium gas. For this purpose, a suction drum having a built-in demister is provided upstream of the compressor.

Conventionally, to suppress the entrained cooling medium mist discharged from a kettle-type heat exchanger, reduction of the flow rate of the cooling medium gas has been performed by enlarging the cooling medium gas holding zone of the heat exchanger or expanding an outlet nozzle of the cooling medium gas. Accordingly, enlargement of the shell diameter of kettle-type heat exchanger, the diameter of suction drum, and the diameter of connection pipes have been inevitable.

SUMMARY OF THE INVENTION

It is an object of the present invention to provide a heat exchanging unit capable of effectively separating within the heat exchanging unit cooling medium mist generated upon boiling of a cooling medium liquid, thereby making it possible to reduce the size of the suction drum, disposed upstream of a compressor, used for removing the cooling medium mist included with the cooling medium gas.

A heat exchanging unit according to the present invention comprises a closed vessel separated into a first compartment and a second compartment by a vertical partition plate of a height lower than the height of the closed vessel thereby to leave above the partition plate a passage connecting the first and the second compartments.

The first compartment has connected thereto a cooling medium inlet pipe; a through pipe, through which a fluid to be cooled is passed, is arranged to pass through the first compartment and includes a heat exchange member at a location lower than the top of the vertical partition plate.

The second compartment is provided with a demister, a cooling medium gas outlet pipe, through which gas separated by the demister flows and a cooling medium liquid outlet pipe connected to the bottom portion of the second compartment.

DESCRIPTION OF THE PREFERRED EMBODIMENTS

Figure 1:
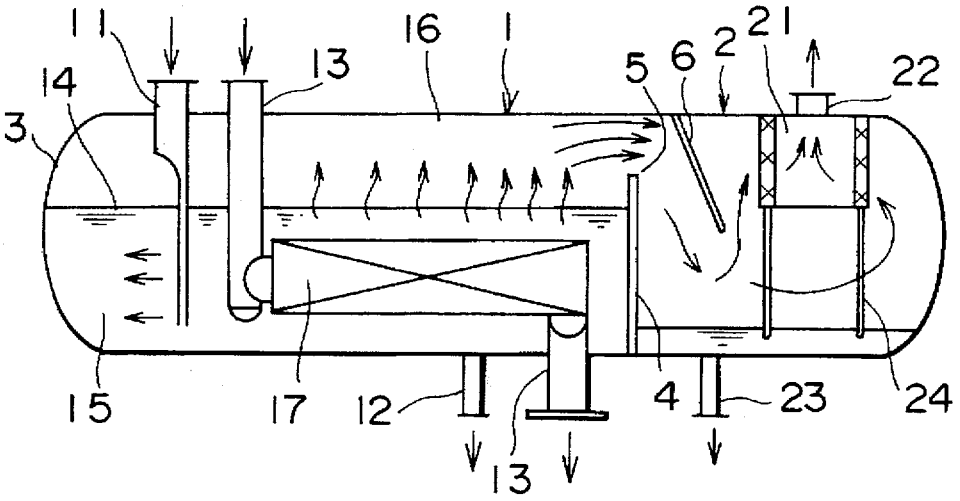
FIG. 1 is a figure showing an embodiment of a heat exchanging unit of the present invention and its working function.

Hereunder, a detailed explanation on the present heat exchanging unit will be given by reference to FIG. 1.

The unit comprises a closed vessel 3 composed of a first compartment 1 and a second compartment 2, and the first compartment 1 and the second compartment 2 are separated by a vertical partition plate 4 of a height lower than the inner height of the closed vessel 1 to thereby leave above the partition plate 4 a passage 5 connecting the first and the second compartment.

The first compartment 1 has a cooling medium inlet pipe 11 connected thereto, and a through pipe 13 through which a fluid to be cooled is passed, is installed to pass through the first compartment 1 and has a heat exchange member 17 placed at a location lower than the top of the vertical partition plate 4.

The second compartment 2 is provided with a demister 21; and a cooling medium gas outlet pipe 22 for the flow of gas separated by the demister is connected to the demister 21. A cooling medium liquid outlet pipe 23 is connected to the bottom portion of the second compartment, through which liquid separated by the demister flows.

A cooling medium liquid discharge pipe 12 can also be connected to the bottom portion of the first compartment 1, if necessary.

The demister 21 preferably has, as shown in FIG. 1, a drain pipe 24 for directing swiftly the separated liquid to the bottom of the second compartment without being affected by any gas flow. A vane-type demister capable of separating the cooling medium mist efficiently without necessitating enlargement of the second compartment is preferred.

Further, for directing the cooling medium gas including cooling medium mist generated in the first compartment toward the demister, a baffle plate 6 is preferably installed in the second compartment to face against the passage 5 existing above the partition plate 4.

The angle at which the baffle plate 6 is installed is not limited specifically, and any angle capable of directing the gas toward the demister as mentioned above is allowable. For example, the baffle plate 6 may be installed in the upper portion of the vessel vertically or obliquely at an appropriate angle as shown in FIG. 1.

The length of the baffle plate 6 is fixed such that the plate extends to a depth lower than the inlet of the demister. Due to the installation of the baffle plate 6 which directs the mist entraining gas to enter the demister via a detour, the gas passes uniformly within the demister and is separated from the entrained mist efficiently. Thus, it is possible to reduce the volume of the second compartment and to make the heat exchanging unit compact.

The heat exchange member 17 of the through pipe 13 in the cooling medium liquid retaining zone 15 in the first compartment is preferably a plate-fin type for improving the heat exchanging efficiency and reducing the shell diameter of the heat exchanging unit.

The working mechanism of the present heat exchanging unit will be explained hereunder. A cooling medium liquid is charged into the first compartment 1 from the cooling medium inlet pipe 11, to maintain the liquid level 14 at a height slightly lower than the height of the partition plate 4, and is discharged from the cooling medium liquid discharge pipe 12. The portion below the liquid level 14 is called the cooling medium liquid retaining zone 15, and the portion above the liquid level 14 is called the cooling medium gas holding zone 16.

The cooling medium has been expanded through an expansion valve (not shown) when it is charged into the closed vessel 3, to lower its own temperature to a boiling point corresponding to the pressure inside the closed vessel, and gasifies partly.

In the first compartment 1, the through pipe 13 equipped with the heat exchange member 17 is located in the cooling medium liquid retaining zone 15 at a position lower than the top of the partition plate. The cooling medium liquid in the cooling medium liquid retaining zone 15 cools the fluid flowing through the heat exchange member 17 of the through pipe 13, gasifies partly, and this gas transfers to the cooling medium gas holding zone 16.

The mist-entrained cooling medium gas in the cooling medium gas holding zone 16 is directed to the second compartment 2 via the passage 5 connecting the first and the second compartments (above the partition plate 4), and enters the demister 21. When a baffle plate 6 is installed in the second compartment 2 to face against the passage 5 between the first and second compartments, the mist entraining cooling medium gas follows a detour around the baffle plate before entering the demister 21.

The cooling medium gas separated by the demister 21 is discharged from the cooling medium gas outlet pipe 22, compressed by a compressor (not shown), liquefied by cooling, and recycled for reuse. The liquid portion separated by the demister 21 is usually used as a cooling medium liquid for the heat exchanging unit of a succeeding stage.

The fluid charged to the cooling medium inlet pipe 11 may be a cooling medium in a liquid phase or in a mixed liquid-gas phase. When a cooling medium liquid is expanded through an expansion valve prior to being charged into the closed vessel, as explained previously, the cooling medium may be in a mixed liquid-gas phase when charged into the first compartment from the cooling medium inlet pipe 11.

In FIG. 1, cooling medium liquid is discharged from the cooling medium liquid discharge pipe 12 connected to the first compartment. However, the heat exchanging unit of the present invention can be operated without discharging the cooling medium liquid from the cooling medium liquid discharge pipe 12, and the unit can be constructed without connecting a cooling medium liquid discharge pipe 12 to the first compartment.

For example, discharge of the cooling medium liquid is almost exclusively done through the cooling medium liquid outlet pipe 23 connected to the bottom of the second compartment in a heat exchanging unit in which the cooling medium has a single pressure level, or in a heat exchanging unit located at the last stage of a multistage heat exchanging apparatus having multiple pressure levels for the cooling medium as described later.

Figure 3:
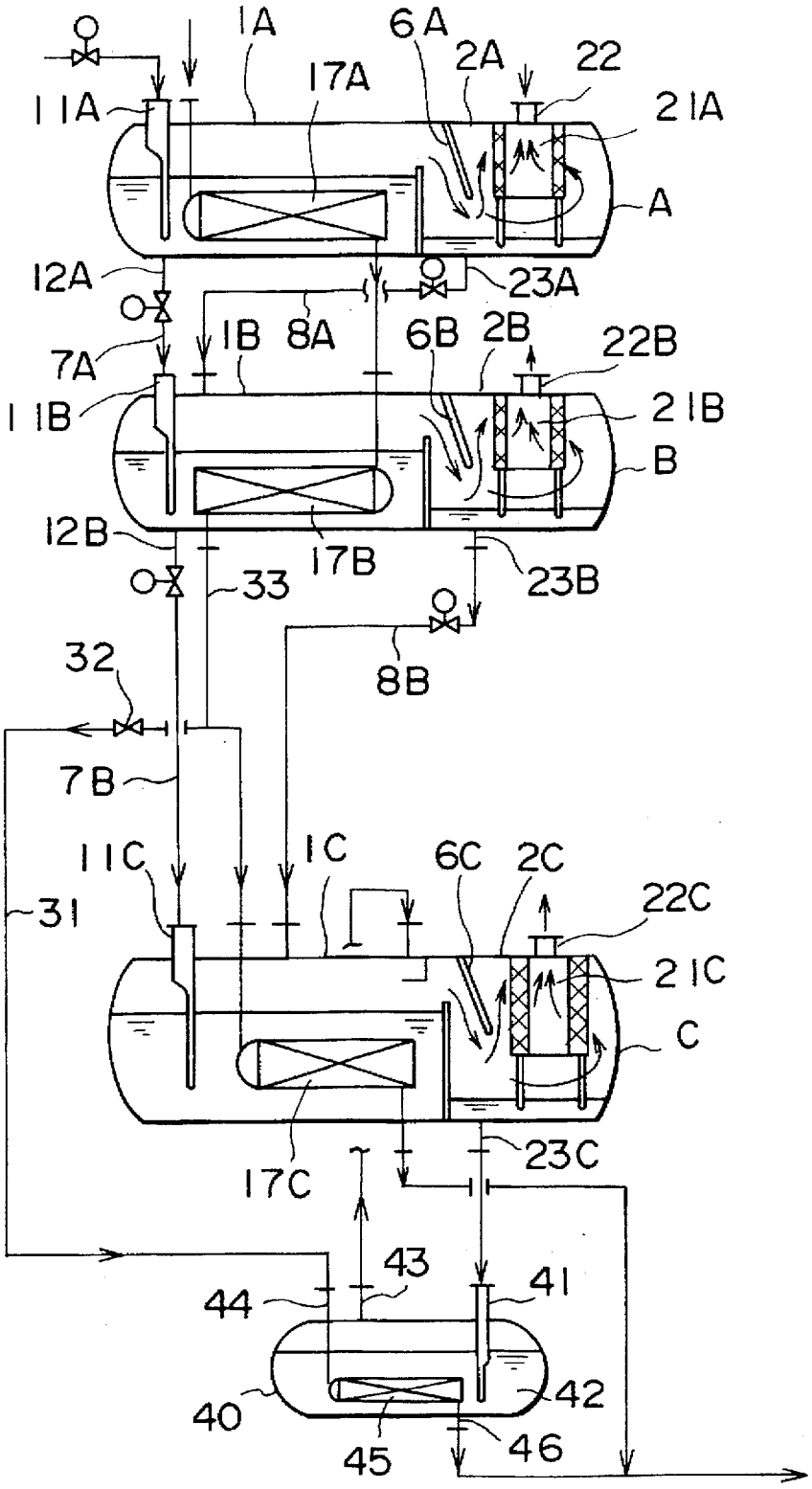
FIG. 3 is a figure showing a combined multistage heat exchanging apparatus formed by integrating a plurality of heat exchanging units of an embodiment of the present invention, together with a mist processing unit.

In a heat exchanging unit having a single pressure level of the cooling medium, for the purpose of processing the cooling medium liquid discharged from the cooling medium liquid outlet pipe 23 connected to the second compartment, a mist processing unit 40 is installed at a location lower than the heat exchanging unit as shown in FIG. 3. The mist processing unit 40 is equipped with pipings for charging gravitationally the cooling medium liquid discharged from the cooling medium liquid outlet pipe 23 of the heat exchanging unit into the mist processing unit 40, and for charging the cooling medium gas discharged from the mist processing unit 40 into the first compartment 1 of the heat exchanging unit.

Since the mist processing unit 40 is supplied with the liquid discharged from the cooling medium liquid outlet pipe 23 connected to the second compartment, the capacity may be smaller than that of the present heat exchanging unit, and any type of heat exchanging units including kettle-type ones are usable. A plate-fin type heat exchange member is preferred.

As stated above, since the heat exchanging unit of the present invention includes a first compartment (a heat exchanging section for carrying out heat exchange between a cooling medium and a fluid to be cooled) and a second compartment (a gas-liquid separating section for separating cooling medium mist from cooling medium gas) separated by a partition plate with an upper passage, and a demister disposed in the second compartment, the cooling medium mist is separated efficiently within the heat exchanging unit so that the cooling medium gas is discharged without any cooling medium mist therein.

Further, since the separation of cooling medium mist is conducted so efficiently in the second compartment, the evaporation rate of cooling medium liquid in the first compartment need not be limited. A fast transfer of mist entraining cooling medium gas from the first compartment to the second compartment is therefore possible. Furthermore, by installing a baffle plate in the second compartment to cause the mist entraining cooling medium gas coming from the first compartment to follow a detour before entering the demister, the separation of the mist by the demister can be carried out efficiently, which enables faster transfer of the mist entraining cooling medium gas from the first compartment to the second compartment.

Additionally, since the cooling medium mist can be processed efficiently within the heat exchanging unit, there is no need to use large diameter pipes for connecting the heat exchanging unit with a suction drum. Moreover a smaller size suction drum relative to those employed with conventional vessels may be used.

Figure 2:
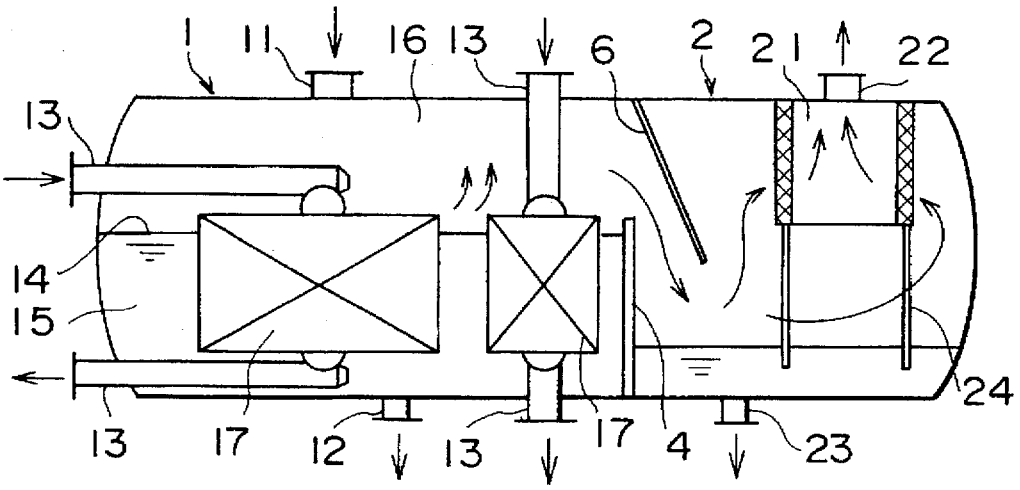
FIG. 2 is a figure showing another embodiment of a heat exchanging unit of the present invention.

FIG. 2 shows another embodiment of heat exchanging unit of the present invention. The through pipe 13 having the heat exchange member 17 placed at a location lower than the top of the vertical partition plate 4 may be a single pipe disposed in the cooling medium liquid retaining zone 15 as shown in FIG. 1, or may comprise two or more pipes disposed in the cooling medium liquid retaining zone 15 as shown in FIG. 2 for cooling different kinds of fluids or a plurality of similar fluids.

When the cooling medium is a liquid phase, the cooling medium inlet pipe 11 may have an opening only in the cooling medium liquid retaining zone 15 or may have an opening extending into both the cooling medium gas holding zone 16 and the cooling medium liquid retaining zone 15 as shown in FIG. 1, or may have an opening only in the cooling medium gas holding zone 16 as shown in FIG. 2.

When the cooling medium is a gas-liquid mixed phase, the inlet pipe preferably has an opening in the cooling medium gas holding zone 16 as shown in FIG. 2, or has an opening extending into both the cooling medium gas holding zone 16 and the cooling medium liquid retaining zone 15 as shown in FIG. 1.

The heat exchanging unit of the present invention can exhibit more remarkably the above discussed features when used as a combined heat exchanging apparatus formed by combining the present heat exchanging unit with a mist processing unit, or as a multistage heat exchanging apparatus formed by integrating two or more of the present heat exchanging units, or as a combined multistage heat exchanging apparatus formed by combining a multistage heat exchange apparatus formed by integrating two or more of the present heat exchanging units with a mist processing unit.

The combined heat exchanging apparatus referred to herein comprises a heat exchanging unit and a mist processing unit.

The heat exchanging unit comprises a closed vessel separated into a first compartment and a second compartment by a vertical partition plate of a height lower than the height of the closed vessel to thereby leave above the partition plate a passage connecting the first and second compartments.

The first compartment has a cooling medium inlet pipe connected thereto: A through pipe, through which a fluid to be cooled passes, is installed to pass through the first compartment and includes a heat exchange member placed at a location lower than the top of the vertical partition plate.

The second compartment is provided with a demister, and has a cooling medium gas outlet pipe connected to the demister and a cooling medium liquid outlet pipe connected to the bottom portion of the second compartment.

The mist processing unit comprises a closed vessel having a cooling medium liquid retaining zone, a cooling medium liquid inlet pipe, a cooling medium gas outlet pipe, a through pipe, through which a fluid to be cooled is passed, arranged to pass through the cooling medium liquid retaining zone and having an outlet and an inlet.

The heat exchange is carried out between the fluid to be cooled in the through pipe and the cooling medium in the cooling medium liquid retaining zone.

The combined heat exchanging apparatus is further provided with piping for charging gravitationally the cooling medium liquid discharged from the cooling medium liquid outlet pipe of the heat exchanging unit into the cooling medium liquid inlet pipe of the mist processing unit. Also, piping provided for charging the cooling medium gas discharged from the cooling medium gas outlet pipe of the mist processing unit into the first compartment of the heat exchanging unit.

The combined heat exchanging apparatus may comprise a branch pipe for branching the fluid to be cooled before entering the inlet of the first through pipe of the heat exchanging unit and passing the branched fluid to be cooled to the inlet of the second through pipe of the mist processing unit.

The multistage heat exchanging apparatus of the present invention is formed by integrating two or more stages of a heat exchanging unit, in which the heat exchanging unit comprises a closed vessel separated into a first compartment and a second compartment by a vertical partition plate of a height lower than the height of the closed vessel to thereby leave above the partition plate a passage connecting the first and the second compartments.

The first compartment is provided with a cooling medium inlet pipe and a through pipe, through which a fluid to be cooled is passed, the through pipe being arranged to pass through the first compartment and including a heat exchange member placed at a location lower than the top of the vertical partition plate.

The second compartment is provided with a demister, and has a cooling medium gas outlet pipe connected to said demister, and a cooling medium liquid outlet pipe connected to the bottom portion of the second compartment.

Further, a cooling medium liquid discharge pipe is connected to the bottom portion of the first compartment and may be connected to a succeeding heat exchanging unit.

The multistage heat exchanging apparatus is further provided with piping for connecting through an expansion valve a cooling medium liquid discharged from the cooling medium liquid discharge pipe of the preceding heat exchanging unit to a cooling medium inlet pipe of the succeeding heat exchanging unit, piping for connecting through an expansion valve a cooling medium liquid discharged from the cooling medium liquid outlet pipe of the preceding heat exchanging unit to the first compartment of the succeeding heat exchanging unit, and piping for connecting the outlet of the through pipe of a preceding heat exchanging unit to the inlet of the through pipe of the succeeding heat exchanging unit.

The combined multistage heat exchanging apparatus is formed with the above-mentioned multistage heat exchanging apparatus succeeded by a mist processing unit installed at a location lower than the last stage heat exchanging unit.

The mist processing unit comprises a closed vessel having a cooling medium liquid retaining zone, a cooling medium liquid inlet pipe, and a cooling medium gas outlet pipe, a through pipe, through which a fluid to be cooled is passed, the through pipe being arranged to pass through the cooling medium liquid retaining zone and having an inlet and an outlet, wherein heat exchange is carried out between the fluid to be cooled in the through pipe and the cooling medium in the cooling medium liquid retaining zone.

The combined heat exchanging apparatus is further provided with piping for charging gravitationally the cooling medium liquid discharged from the cooling medium liquid outlet pipe of the last stage heat exchanging unit into the cooling medium liquid inlet pipe of the mist processing unit, and piping for charging the cooling medium gas discharged from the cooling medium gas outlet pipe of the mist processing unit into the first compartment of the last stage heat exchanging unit.

The combined multistage heat exchanging apparatus of the present invention formed by integrating two or more stages of a heat exchanging unit will be explained by reference to FIG. 3. In FIG. 3, A denotes a first heat exchanging unit, B denotes a second heat exchanging unit and C denotes a third unit, and the components of these units are referred by the reference numbers in FIG. 1 attached with A, B or C. A cooling medium liquid discharge pipe 12 is connected respectively to the bottom portion of the first compartment of heat exchanging units A and B, but C has no such cooling medium liquid discharge pipe.

Pipings installed are 7A for passing through an expansion valve the cooling medium liquid discharged from the cooling medium liquid discharge pipe 12A of the first heat exchanging unit A to the cooling medium inlet pipe 11B of the second heat exchanging unit B, 8A for passing through an expansion valve the cooling medium liquid discharged from the cooling medium liquid outlet pipe 23A of the first heat exchanging unit to the first compartment 1B of the second heat exchanging unit B, 7B for passing through an expansion valve the cooling medium liquid discharged from the cooling medium liquid discharge pipe 12B of the second heat exchanging unit B to the cooling medium inlet pipe 11C of the third heat exchanging unit C, and 8B for passing through an expansion valve the cooling medium liquid discharged from the cooling medium liquid outlet pipe 23B of the second heat exchanging unit to the first compartment 1C of the third heat exchanging unit C.

The fluid to be cooled is passed successively through the heat exchange member 17A of the through pipe of the first heat exchanging unit A, the heat exchange member 17B of the through pipe the second heat exchanging unit B, and the heat exchange member 17C of the through pipe of the third heat exchanging unit C. Since the pressure in each heat exchanging unit is reduced successively by means of the expansion valves along the first heat exchanging unit A, the second heat exchanging unit B and the third heat exchanging unit C, the temperature of cooling medium liquid in each heat exchanging unit is lowered successively, so that fluid to be cooled is also cooled successively. In a similar manner, a far greater number of heat exchanging units can be integrated.

In FIG. 3, the cooling medium liquid discharged gravitationally from the cooling medium liquid outlet pipe 23C of the third (last stage) heat exchanging unit C is used as the cooling medium for the mist processing unit 40.

The mist processing unit 40 is provided with a cooling medium inlet pipe 41, a cooling medium liquid retaining zone 42, a cooling medium gas outlet pipe 43, a through pipe including a heat exchange member 45, having an inlet 44 and an outlet 46, through which a fluid to be cooled is passed. Heat exchange is carried out between the fluid to be cooled in the heat exchange member 45 and the cooling medium in the cooling medium liquid retaining zone 42. As the mist processing unit 40 is used for processing the mist separated by the last stage of the present multistage heat exchanging apparatus, the capacity is usually considerably smaller than those of the first to third heat exchanging units.

FIG. 3 shows an example in which a part of the fluid to be cooled is branched from a pipe 33 connecting the outlet of the through pipe of the second heat exchanging unit B with the inlet of the through pipe of the third heat exchanging unit C, and the branched fluid is passed through the branch pipe 31 to the inlet of the through pipe 44 of the mist processing unit 40.

When a specified amount of cooling medium from the cooling medium liquid outlet pipe 23C is stored in the cooling medium liquid retaining zone 42 of the mist processing unit 40, the fluid to be cooled is directed, by opening the valve 32, through branch pipe 31 and the inlet 44 to the heat exchange member 45.

When the amount of cooling medium in the mist processing unit 40 is zero or smaller than a specified amount, the fluid to be cooled may be stopped from flowing toward the inlet 44 of the mist processing unit 40 by closing the valve 32 of the branch pipe 31. The cooling medium flowing through the cooling medium inlet 41 into the cooling medium liquid retaining zone 42 of the mist processing unit 40 gasifies partly by the heat exchanging between the fluid to be cooled in the heat exchange member 45, and the gasified cooling medium is charged into the first compartment of the last stage heat exchanging unit C.

By combining the heat exchanging unit with a mist processing unit, the cooling medium accumulated in the second compartment of the last stage can be processed to achieve effective utilization of the cooling medium.

In the present invention, as stated above, mist generated upon boiling of a cooling medium can effectively be separated within the heat exchanging unit without depressing the evaporation velocity of gas formed at the interface of liquid and gas in the first compartment. As the gas discharged from the cooling medium gas outlet pipe by demister 22A, 22B and 22C has no mist included therewith, the installation of mist catchers before (upstream from) compressors is not required. Further, as respective second compartments 2A, 2B and 2C have a mist catching capacity matching that of suction drums of compressors, the installation of separate suction drums is not required.

In the present invention, it is possible to separate effectively within the heat exchanging unit mist generated upon boiling of a cooling medium without depressing the evaporation velocity of gas formed at the interface of liquid and gas in the first compartment. Since cooling medium gas discharged from the heat exchanging unit has no cooling medium mist included therewith, there is no need to install large diameter piping for connecting suction drums, which are commonly disposed upstream of compressors for the cooling medium gas. Moreover and even the suction drum itself can be eliminated.

In the present invention, both a heat exchange member for heat exchange between a cooling medium and a fluid to be cooled and a gas-liquid separating member for separating cooling medium mist included with cooling medium gas are disposed within one unit; the structure of the unit is simple and compact.

In the present invention, since a demister is installed in the second compartment as the gas-liquid separating member and the cooling medium mist entraining cooling medium gas from the first compartment passes through the demister uniformly via a detour using a baffle plate or the like, the mist is separated efficiently from the cooling medium gas medium. Thus, it is possible to reduce the space of the second compartment, and to make the heat exchanging unit more compact.

By combining one set of the present heat exchanging unit with a mist processing unit, by integrating two or more sets of the unit to form a multistage heat exchanging apparatus, or by combining the multistage heat exchanging unit with a mist processing unit, it has become possible to utilize effectively cooling medium mist separated from cooling medium gas as a cooling medium of fluid to be cooled.

According to conventional systems of natural gas liquefaction, ethylene purification, LPG recovery, etc. by low temperature processing, a plurality of heat exchanging equipments operated at different pressures were necessary and a plurality of equipments were needed at each step; however, integration of such equipments is feasible in the present heat exchanging unit to simplify and compact the total cooling system.

What is claimed is:

1. A heat exchanging unit comprising:

a closed vessel separated by a vertical partition plate into a first compartment for cooling a fluid to be cooled with a liquid medium and a second compartment for receiving a mist separated from the liquid medium, said first compartment containing the liquid medium maintained at a predetermined liquid level height, said partition plate having a height higher than said predetermined liquid level height and lower than the height of said closed vessel to thereby define above said vertical partition plate a passage connecting said first and second compartments;

a cooling medium inlet pipe connected to said first compartment;

liquid medium inlet control means and liquid medium outlet control means for respectively controlling flows of the liquid medium into and out of the first compartment of the closed vessel and for collectively maintaining the predetermined liquid level height;

a through pipe through which the fluid to be cooled is passed, said through pipe being arranged to pass through said first compartment and including a heat exchange member disposed in said first compartment at a height lower than the top of said vertical partition plate;

a demister disposed in said second compartment;

a cooling medium gas outlet pipe connected to said demister; and a cooling medium liquid outlet pipe connected to the lower portion of said second compartment.

2. The heat exchanging unit according to claim 1, further comprising a baffle plate disposed in said second compartment to oppose the passage defined above said vertical partition plate.

3. The heat exchanging unit according to claim 1 or 2, wherein said demister is a vane-type demister.

4. The heat exchanging unit according to claim 1, wherein a plurality of through pipes are arranged to pass through said first compartment, each including a heat exchange member.

5. The heat exchanging unit according to claim 1 wherein the heat exchange member is a plate-fin type heat exchange member.

6. A combined heat exchanging apparatus comprising a heat exchanging unit and a mist processing unit disposed at a location lower than said heat exchanging unit, said heat exchanging unit comprising: a first closed vessel separated by a vertical partition plate into a first compartment for cooling a fluid to be cooled with a liquid medium and a second compartment for receiving a mist separated from the liquid medium, said vertical partition plate having a height lower than the height of said first closed vessel to thereby define above said vertical partition plate a passage connecting said first and second compartments; a first cooling medium inlet pipe connected to said first compartment; liquid medium inlet control means and liquid medium outlet control means for respectively controlling flows of the liquid medium into and out of the first compartment of the closed vessel and for collectively maintaining the liquid medium in the first compartment at a predetermined liquid level height lower than said height of said vertical partition plate; a first through pipe through which the fluid to be cooled is passed, said first through pipe being arranged to pass through said first compartment and including a first heat exchange member disposed in said first compartment at a height lower than the top of said vertical partition plate; a demister disposed in said second compartment; a first cooling medium gas outlet pipe connected to said demister; and a first cooling medium liquid outlet pipe connected to the lower portion of the second compartment;

said mist processing unit comprising: a second closed vessel having a cooling medium liquid retaining zone; a second cooling medium liquid inlet pipe connected to said second closed vessel; a second cooling medium gas outlet pipe connected to said second closed vessel; a second through pipe through which a fluid to be cooled is passed, said second through pipe being arranged to pass through said cooling medium liquid retaining zone of said second closed vessel and having an inlet and an outlet;

wherein said first cooling medium liquid outlet pipe of said heat exchanging unit is connected to said second cooling medium liquid inlet pipe of said mist processing unit such that cooling medium liquid separated from said demister is supplied under the effect of gravity from said second compartment to said mist processing unit; and wherein said second cooling medium gas outlet pipe of said mist processing unit is connected to said first compartment of said heat exchanging unit such that cooling medium gas generated in said mist processing unit is returned to said heat exchanging unit.

7. The combined heat exchanging apparatus according to claim 6, further comprising a branch pipe for branching the fluid to be cooled before the inlet of said first through pipe of said heat exchanging unit and passing the branched fluid to be cooled to said inlet of said second through pipe of said mist processing unit.

8. The combined heat exchanging apparatus according to claim 6, wherein said heat exchanging unit further comprises a baffle plate disposed in the second compartment of said heat exchanging unit to oppose the passage defined above said vertical partition plate.

9. The combined heat exchanging apparatus according to claim 6 wherein said demister is a vane-type demister.

10. The combined heat exchanging apparatus according to claim 6 wherein a plurality of first through pipes are arranged to pass through said first compartment of said heat exchanging unit, each including a heat exchange member.

11. The combined heat exchanging apparatus according to claim 6 wherein the heat exchange member of said heat exchanging unit is a plate-fin type heat exchange member.

12. A multistage heat exchanging apparatus comprising a series of heat exchanging units, each of said heat exchanging units comprising: a closed vessel separated by a vertical partition plate into a first compartment for cooling a fluid to be cooled with a liquid medium and a second compartment for receiving a mist separated from the liquid medium, said vertical partition plate having a height lower than the height of said closed vessel to thereby define above said vertical partition plate a passage connecting said first and second compartments; a cooling medium inlet pipe connected to said first compartment; liquid medium inlet control means and liquid medium outlet control means for respectively controlling flows of the liquid medium into and out of the first compartment of the closed vessel and for collectively maintaining the liquid medium in the first compartment at a predetermined liquid level height lower than said height of said vertical partition plate; a through pipe through which the fluid to be cooled is passed, said through pipe being arranged to pass through said first compartment and including a heat exchanging member disposed in said first compartment at a height lower than the top of said vertical partition plate; a demister disposed in said second compartment; a cooling medium gas outlet pipe connected to said demister; a cooling medium liquid outlet pipe connected to the lower portion of the second compartment; and a cooling medium liquid discharge pipe connected to the lower portion of said first compartment of at least each of said heat exchanging units, with the exception of a last said heat exchanging unit of said series;

wherein said cooling medium liquid discharge pipe of any heat exchanging unit is connected to said cooling medium inlet pipe of the succeeding heat exchanging unit via an expansion valve;

said cooling medium liquid outlet pipe of any heat exchanging unit is connected to said first compartment of a succeeding heat exchanging unit via an expansion valve; and said outlet of said through pipe of any heat exchanging unit is connected to the inlet of said through pipe of a succeeding heat exchanging unit.

13. A combined multistage heat exchanging apparatus comprising a series of heat exchanging units and a mist processing unit disposed at a location lower than the last heat exchanging unit of said series of heat exchanging units, each heat exchanging unit comprising: a first closed vessel separated by a vertical partition plate into a first compartment for cooling a fluid to be cooled with a liquid medium and a second compartment for receiving a mist separated from the liquid medium, said vertical partition plate having a height lower than the height of said first closed vessel to thereby define above said vertical partition plate a passage connecting said first and second compartments; a first cooling medium inlet pipe connected to said first compartment; liquid medium inlet control means and liquid medium outlet control means for respectively controlling flows of the liquid medium into and out of the first compartment of the closed vessel and for collectively maintaining the liquid medium in the first compartment at a predetermined liquid level height lower than said height of said vertical partition plate; a first through pipe through which the fluid to be cooled is passed, said first through pipe being arranged to pass through said first compartment and including a first heat exchange member disposed in said first compartment at a height lower than the top of said vertical partition plate; a demister disposed in said second compartment; a first cooling medium gas outlet pipe connected to said demister; a first cooling medium liquid outlet pipe connected to the lower portion of the second compartment; and a cooling medium liquid discharge pipe connected to the lower portion of said first compartment of at least each of said heat exchanging units, with the exception of a last said heat exchanging unit of said series;

said cooling medium liquid discharge pipe of any heat exchanging unit being connected to said first cooling medium inlet pipe of the succeeding heat exchanging unit via an expansion valve;

said first cooling medium liquid outlet pipe of any heat exchanging unit, with the exception of said last said heat exchanging unit of said series, being connected to said first compartment of a succeeding heat exchanging unit via an expansion valve;

said outlet of said first through pipe of any heat exchanging unit being connected to the inlet of said first through pipe of a succeeding heat exchanging unit;

said mist processing unit comprising: a second closed vessel having a cooling medium liquid retaining zone; a second cooling medium liquid inlet pipe connecting said second closed vessel to said first cooling medium liquid outlet pipe of the last said heat exchanging of said series such that cooling medium liquid separated from said demister of the last said heat exchanging unit of said series is supplied under the effect of gravity to said mist processing unit; a second cooling medium gas outlet pipe connecting said second closed vessel to said first compartment of the last said heat exchanging unit of said series such that the cooling medium gas generated in said mist processing unit is returned to the last heat exchanging unit of said series of heat exchanging units; a second through pipe through which a fluid to be cooled is passed, said second through pipe being installed to pass through said cooling medium liquid retaining zone of said second closed vessel and having an inlet and an outlet.

14. The combined multistage heat exchanging apparatus according to claim 13, further comprising a branch pipe for branching the fluid to be cooled before the inlet of said first through pipe of the last said heat exchanging unit of said series of heat exchanging units and passing the branched fluid to be cooled to said inlet of said second through pipe of said mist processing unit.

15. The combined multistage heat exchanging apparatus according to claim 13 wherein each said heat exchanging unit further comprises a baffle plate disposed in said second compartment to oppose the passage defined above said vertical partition plate.

16. The combined multistage heat exchanging apparatus according to claim 13 wherein said demister is a vane-type demister.

17. The combined multistage heat exchanging apparatus according to claim 13, wherein a plurality of first through pipes are installed to pass through said first compartment, each including a heat exchange member.

18. The combined multistage heat exchanging apparatus according to claim 13 wherein said heat exchange member is a plate-fin type heat exchange member.

* * * * *